United States Patent [19]

Parisi et al.

[11] Patent Number: 4,674,189

[45] Date of Patent: Jun. 23, 1987

[54] TAILOR'S MARKER AND METHOD

[75] Inventors: Joseph Parisi; Joseph A. Parisi, both of Utica, N.Y.

[73] Assignee: Maria D. Parisi, Utica, N.Y.

[21] Appl. No.: 850,128

[22] Filed: Apr. 10, 1986

[51] Int. Cl.[4] ..... A41H 1/00; A41H 1/02

[52] U.S. Cl. ..... 33/8; 33/2 H

[58] Field of Search ..... 33/2 H, 8, 9 R, 10

[56] References Cited

U.S. PATENT DOCUMENTS

| | | | |
|---|---|---|---|
| 2,665,483 | 1/1954 | Sabatini | 33/2 H |
| 2,721,388 | 10/1955 | Karrett, Sr. | 33/8 |
| 2,734,270 | 2/1956 | Finnegan | 33/8 |
| 3,094,782 | 6/1963 | Galindo | 33/2 H |
| 3,400,460 | 9/1968 | Sullivan | 33/2 H |
| 3,522,656 | 8/1970 | Paranzino | 33/2 H |

*Primary Examiner*—Richard R. Stearns

*Attorney, Agent, or Firm*—Harvey B. Jacobson

[57] ABSTRACT

Apparatus for use in marking below waist garments such as trousers, slacks, jeans, skirts and dresses has a floor stand with a slide that can be adjusted vertically to mark garments at varying heights in accordance with respective indicia marks on the stand. The device may be used in combination with a T-square-like measuring device of a set length related to the length of the stand for marking trouser lengths. The device may also have a marking and a rule for use in measuring and marking skirts and dresses to specified heights above floor level.

13 Claims, 4 Drawing Figures

TAILOR'S MARKER AND METHOD

BACKGROUND AND SUMMARY OF THE INVENTION

This invention relates to an apparatus and method of using same for marking below waist garments such as trousers, slacks, jeans, skirts, coats and dresses to permit accurate finishing of the garments to a desired length.

It is common practice for tailors, and alteration hands, for example, when fitting trousers, jeans, skirts and the like on a wearer to physically adjust the length of the garments by turning in the hem to the required height and temporarily pinning the material at the required level. This is an awkward and time consuming operation and the invention accordingly provides an apparatus and method of marking garments for subsequent finishing to length which avoids the need for temporarily pinning up the hem.

The invention provides, inter alia, apparatus in the form of a floor stand having a base, an upright extending substantially vertically from the base, a slide associated with the upright for vertical sliding movement thereon, the slide having a top end projecting above the upright, an indicator device on the upright marked with vertically spaced garment length determining indicia, a mark on the slide alignable selectively with the indicia for setting the top end of the slide at a level above the upright corresponding with a selected indicium so that the top end of the slide may be used as an indicator for making a datum marking on the garment, and holding means for releasably holding the slide in the set position on the upright. The indicia preferably are trouser length determining indicia comprising respectively top to bottom a no-break indicium, a medium break indicium and a full break indicium. In use, when fitting trousers on a wearer, the stand is placed adjacent the outside of the wearer's leg and dependent upon whether the wearer prefers the trousers to have no break, a medium break or a full break, the mark on the slide is aligned with the respective indicium on the upright and releasably secured in position. Then, the top of the slide is used to form a datum marking on the outside of the trousers. The operation can then be repeated on the other leg of the trousers. When removed from the wearer, a measuring device such as a T-square of set length related to the length of the upright is used for measuring off a length of garment below the datum marking to which the garment is to be finished. The garment is then hemmed to the level indicated by the measuring device.

In a preferred form of the invention, the base of the stand is shaped in plan on either side to conform with the outline of a shoe, the base having a thin elongate central portion from which the upright extends and enlarged stabilizing ends. The top of the slide is formed with a plate which is wider than the central portion of the base so that in use, a person on whom a garment is being measured places the outside of his or her shoe adjacent the edge of the base. The plate at the top of the slide provides proximity to a garment being marked.

A further feature of the invention resides in the provision of a height indicating mark on the upright for establishing a predetermined height of garment above floor level and a removable rule for the slide with an indicator which can be set in alignment with the mark or, by movement of the slide, can be set at varying heights above the mark. This enables the apparatus to be used for marking skirts, dresses and the like to predetermined heights above floor level.

Applicant is aware of the following U.S. patents relating to tailors' marking devices and the like. None of these patents, however, discloses a device having the features of the present invention.

| | |
|---|---|
| 1,346,832 | July 20, 1920 |
| 1,456,547 | May 29, 1923 |
| 2,630,629 | Mar. 10, 1953 |
| 2,665,483 | Jan. 12, 1954 |
| 2,677,889 | May 11, 1954 |
| 3,094,782 | June 25, 1963 |

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 4:
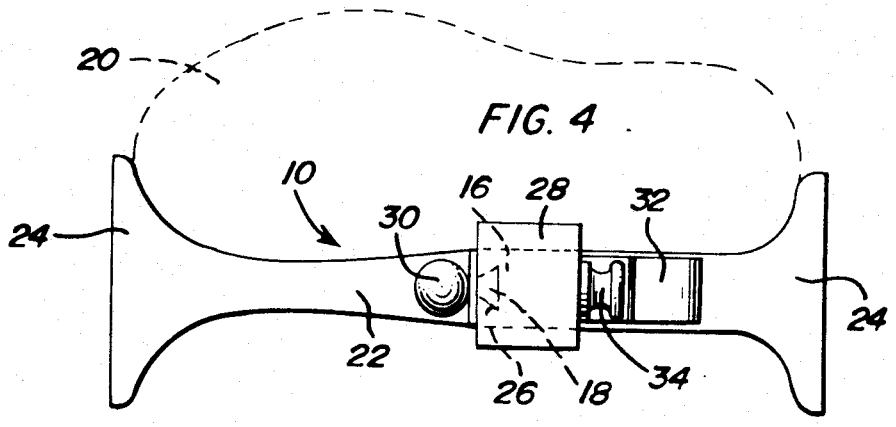
FIG. 4 is a plan view of the apparatus shown in FIG. 1.

Tailors's marking apparatus in accordance with the invention comprises, in general, a floor stand 10 and a T-square type measuring device 12, both of which may be made out of suitable hardwood or like materials. Floor stand 10 includes a base member 14, an upright 16 and a slide 18. As best seen in FIG. 4, the base 14 is shaped in plan so that its opposite edges generally are contoured to conform with the outside of a shoe such as the shoe shown at 20 in phantom. The base has a thin elongate central section 22 and enlarged stabilizing ends 24. Upright 16 is suitably secured in substantially vertical position to central section 22 of the base.

The forward edge of the upright 16 is formed with a dovetailed groove 26 and slide 18 is of complementary dovetail shape slidingly received in the groove. The top of the slide projects above the upright and is provided with a plate 28 which is about one inch wider at each side than the central section 22 of the base. The slide may be selectively secured in required position on the upright 16 by means of an adjustment knob 30 which forms the head of a screw (not shown) which is threaded through the slide and can be tightened by means of knob 30 against groove 26 to selectively secure the slide in position. The stand is provided with a stabilizing brace 32 and a lifting handle 34.

Figure 3:
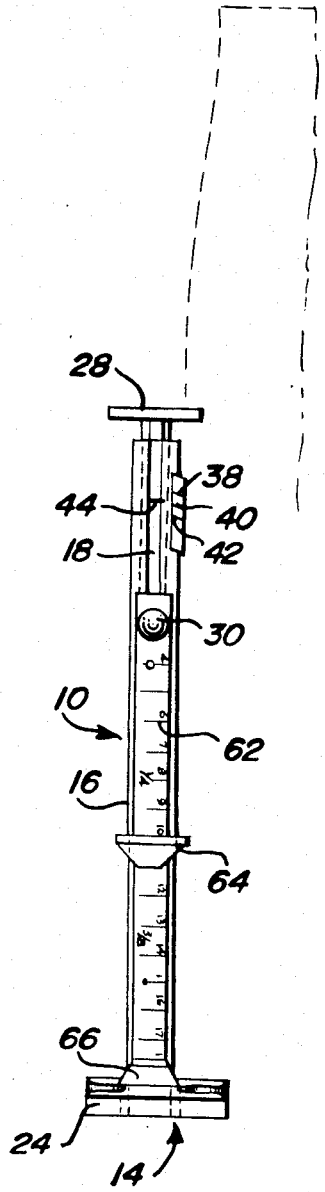
FIG. 3 is a front elevational view of the apparatus shown in FIG. 1.

Near the top of the upright, at least on one side, is a label 36 which may be a pressure sensitive or the like label carrying indicia marks 38, 40, 42 for indicating trouser lengths, mark 38 representing a no-break length, mark 40 representing a medium break length and mark 42 representing a full break length. As shown in FIG. 3, label 36 may have a portion which is folded around the front of the upright. Also shown in FIG. 3 is a mark 44 on the slide which can be aligned selectively with the respective indicia marks, 38, 40, 42 and the slide can be secured in the respectively aligned positions by means of the knob 30.

Figure 1:
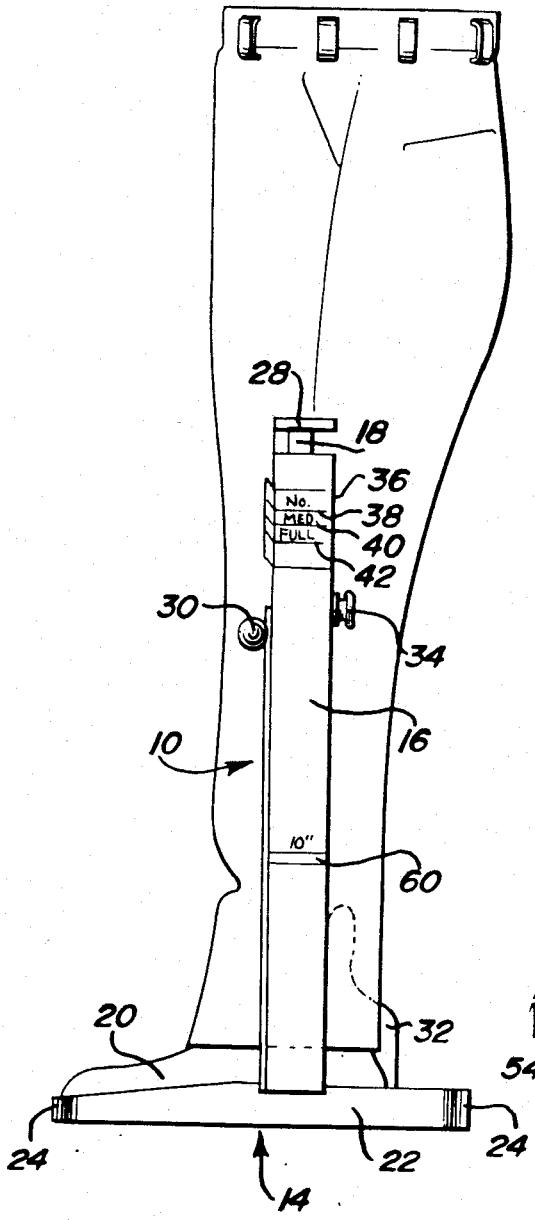
FIG. 1 is in-use side elevational view of a garment length measuring apparatus in accordance with the invention.
Figure 2:
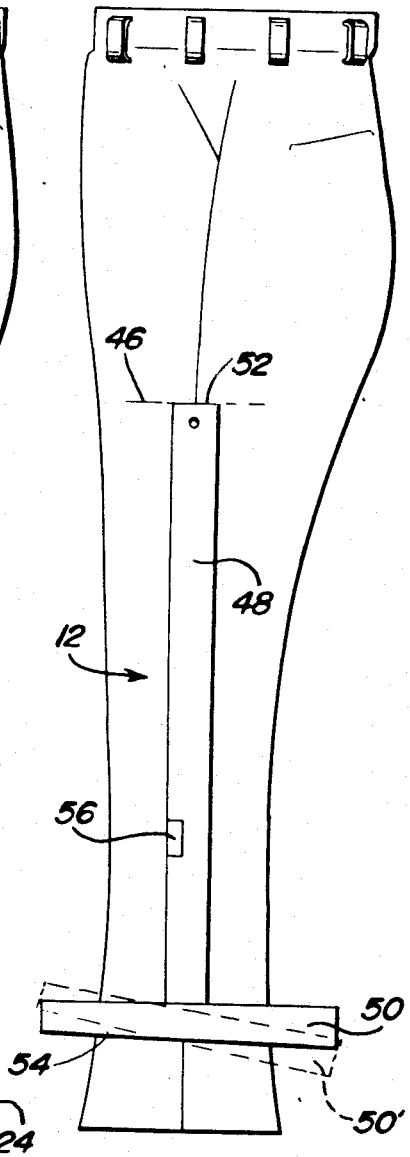
FIG. 2 is in-use side elevational view of a further element of the apparatus.

To mark a pair of trousers, slacks, jeans or the like using the apparatus as thus far described, the stand is placed adjacent the outside of the wearer's leg, as shown in FIGS. 1 and 4 so that the side of the base substantially engages the outside of the wearer's shoe. Dependent on whether the wearer prefers the trousers or the like to have no break, a medium break, or a full break, the slide is adjusted so as to bring mark 44 into alignment with the respective indicia 38, 40 or 42 and secured in place by knob 30. Plate 28 at the top of the slide will be adjacent or engaged with the side of the trousers and a datum marking 46 may be made on the trousers at the top of plate 28 by chalk or the like. The stand may then be moved around to the other leg and the process repeated. The trousers may then be removed for subsequent marking and finishing by means of the T-square device 12. This device comprises an elongate stem 48 and a crossbar 50. The overall length of the device is related to the length of upright 16 so that when the free end 52 of the stem is placed on marking 46 the bottom edge 54 of crossbar 50 is at the required length level for the bottom of the trouser leg. A chalk mark may then be made across the trousers at this level. The trousers may then be cut to length below this level leaving a required amount of material for hemming and/or cuffing. As shown in phantom line in FIG. 2, the crossbar 50' may be slanted if trousers with a front-to-back incline are required and the device may be provided with a label 56 to indicate the front.

It will be appreciated that the apparatus and method described above allow for simple and accurate marking of trouser leg lengths without having to go through the cumbersome operation of pinning up the trousers.

The apparatus further includes means for marking skirts, dresses and the like to specified heights above floor level. To this end, upright 16 is provided with a mark 60, preferably on both sides, at a specified height, for example, ten inches, above floor level. Further, the slide 18 is provided with a removable rule 62 which may, for example, be suspended from knob 30. The rule is marked in inches from the top down and includes an indicator 64 at the 10-inch mark. Thus, when indicator 64 is level with mark 60, it can be used to mark a skirt, dress or the like to a height 10 inches above the floor. However, if a different height above floor level is required, slide 18 can be moved up or down so as to bring the required inch marking on the rule into alignment with mark 60. Then, when the slide is secured in position by knob 30, indicator 64 can be used to mark the dress or skirt and the marked level will correspond to the height above floor level of the inch mark on the rule which is aligned with mark 60. For example, if it is required to mark a skirt to a level 12 inches above the floor, the slide is raised to bring the 12-inch mark to alignment with mark 60 and secured in position. Thus, the apparatus offers the further facility for readily marking garments to a required height above floor level.

Optionally, the rule may be provided with a further indicator 66 at the base which is spaced from the top of the slide by an amount corresponding to the overall length of the T-square device 48 so that indicator 66 can be used directly to mark trousers to the required leg length.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. Apparatus for use in marking a below-waist garment to permit accurate finishing of the garment to a desired length, the apparatus comprising a floor stand having a base, an upright extending substantially vertically from the base, a slide associated with the upright for vertical sliding movement thereon, the slide having a top end projecting above the upright, an indicator device on the upright marked with vertically spaced garment length determining indicia, a mark on the slide alignable selectably with said indicia for setting the top end of the slide at a level above the upright corresponding with a selected indicium so that the top end of the slide may be used as an indicator for making a datum marking marking on the garment, holding means for releasably holding the slide in the set position on the upright and a measuring device of set length related to the length of the upright for measuring off a length of garment below said datum marking to which the garment is to be finished, said base being shaped in plan to conform on each side substantially with the outline of a shoe, the base having a thin elongated central portion on which the upright is mounted, and enlarged stabilizing ends, and wherein the slide has a plate on top which is wider than the central portion of the base so as to provide proximity to a garment being marked when the wearer stands with his or her shoe adjacent one side of the base.

2. The apparatus of claim 1 wherein the slide has a dovetail fit in a groove formed in the upright and wherein the holding means is a headed screw threaded through the slide for tightening against the groove so as to selectively hold the slide in selected position in the groove.

3. The apparatus of claim 2 wherein the upright has an indicator mark at a specified distance above the base for indicating a specified height for a garment above floor level and wherein the slide has a measuring rule releasably suspended from the screw including an indicator alignable with said indicator mark for marking the garment at said specified height and spaced measurements on the rule selectively alignable with said indicator mark by movement of the slide so as to adjust the position of the indicator for marking garments at different heights above floor level corresponding to said measurements.

4. The apparatus of claim 1 wherein the upright has an indicator mark at a specified distance above the base for indicating a specified height for a garment above floor level and wherein the slide is provided with a measuring rule including an indicator alignable with said indicator mark for marking a garment at said specified height, and spaced measurements on the rule selectively alignable with said indicator mark by movement of the slide so as to adjust the position of the indicator for marking garments at different heights above floor level corresponding to said measurements.

5. The apparatus of claim 1 wherein the measuring device is a T-square-like device having an elongate stem and a crossbar with a free edge for making a line across the garment when a free end of the stem is placed at the datum marking.

6. The apparatus of claim 5 wherein the free edge of the crossbar is inclined with respect to the stem.

7. Apparatus for use in marking a below-waist garment to permit accurate finishing of the garment to a desired length, the apparatus comprising a floor stand having a base, an upright extending substantially vertically from the base, a slide associated with the upright for vertical sliding movement thereon, the slide having a top end projecting above the upright, an indicator device on the upright marked with vertically spaced garment length determining indicia, a mark on the slide alignable selectably with said indicia for setting the top end of the slide at a level above the upright corresponding with a selected indicium so that the top end of the slide may be used as an indicator for making a datum marking on the garment, holding means for releasably holding the slide in the set position on the upright, an indicator mark on the upright a specified distance above the base for indicating a specified height for a garment above floor level, and a measuring rule on the slide including an indicator alignable with said indicator mark for marking a garment at said specified height, and spaced measurements on the rule selectively alignable with said indicator mark by movement of the slide so as to adjust the position of the indicator for marking garments at different heights above floor level corresponding to said measurements.

8. The apparatus of claim 7 wherein the rule is releasably suspended from a knob on the slide.

9. The apparatus of claim 8 wherein the base is shaped in plan to conform on each side substantially with the outline of a shoe, the base having a thin elongate central portion on which the upright is mounted and enlarged stabilizing ends, and wherein the slide has a plate on top which is wider than the central portion of the base so as to provide proximity to a garment being marked when a wearer stands with his or her shoe adjacent one side of the base.

10. Apparatus for use in marking a below-waist garment to permit accurate finishing of the garment to a desired length, the apparatus comprising a floor stand having a base, an upright extending substantially vertically from the base, a slide associated with the upright for vertical sliding movement thereon, the slide having a top end projecting above the upright, an indicator device on the upright marked with vertically spaced garment length determining indicia, a mark on the slide alignable selectably with said indicia for setting the top end of the slide at a level above the upright corresponding with a selected indicium so that the top end of the slide may be used as an indicator for making a datum marking on the garment, holding means for releasably holding the slide in the set position on the upright, wherein the base is shaped in plan to conform on each side substantially with the outline of a shoe, the base having a thin elongate central portion on which the upright is mounted and enlarged stabilizing ends, and wherein the slide has a plate on top which is wider than the central portion of the base so as to provide proximity to a garment being marked when a wearer stands with his or her shoe adjacent one side of the base.

11. The apparatus of claim 10 wherein the upright has an indicator mark a specified distance above the base for indicating a specified height for a garment above floor level, and a measuring rule on the slide including an indicator alignable with said indicator mark for marking a garment at said specified height, and spaced measurements on the rule selectively alignable with said indicator mark by movement of the slide so as to adjust the position of the indicator for marking garments at different heights above floor level corresponding to said measurements.

12. The apparatus of claim 11 wherein the rule is releasably suspended from a knob on the slide.

13. The apparatus of claim 11 wherein the rule has a further indicator below the indicator aforesaid for the direct marking of trouser lengths.

* * * * *